US006718637B1

(12) United States Patent
Ortner et al.

(10) Patent No.: US 6,718,637 B1
(45) Date of Patent: Apr. 13, 2004

(54) AUTOMATIC SAFETY KNIFE

(75) Inventors: Mel Wayne Ortner, 3421 Huppe La., Berthoud, CO (US) 80513; Donald R. Schwartz, Longmont, CO (US); Timothy A. Turley, Highlands Ranch, CO (US); Fred K. Kueffner, Longmont, CO (US)

(73) Assignee: Mel Wayne Ortner, Berthoud, CO (US)

( * ) Notice: Subject to any disclaimer, the term of this patent is extended or adjusted under 35 U.S.C. 154(b) by 0 days.

(21) Appl. No.: 10/339,972

(22) Filed: Jan. 10, 2003

Related U.S. Application Data

(60) Division of application No. 09/863,511, filed on May 23, 2001, now Pat. No. 6,560,873, which is a continuation-in-part of application No. 09/439,133, filed on Nov. 12, 1999, now abandoned.

(51) Int. Cl.[7] ..... B67B 7/00; B26B 3/08; B26B 5/00; B26B 29/02

(52) U.S. Cl. ..... 30/2; 30/286; 30/294

(58) Field of Search ..... 30/2, 333, 332, 30/125, 151, 153, 320, 293, 294, 331, 338, 340, 162, 337

(56) References Cited

U.S. PATENT DOCUMENTS

| | | | | |
|---|---|---|---|---|
| 142,942 A | | 9/1873 | Ratelle | |
| 1,796,870 A | * | 3/1931 | Huhn et al. | 30/2 |
| 2,187,590 A | * | 1/1940 | Lurie | 30/2 |
| 2,215,216 A | * | 9/1940 | Gits et al. | 30/162 |
| 2,291,075 A | * | 7/1942 | Hanson | 30/2 |
| 2,376,887 A | | 5/1945 | Walters | 30/286 |
| 2,644,230 A | * | 7/1953 | Anderson | 30/151 |
| 2,730,800 A | * | 1/1956 | Bailey | 30/2 |
| 2,743,523 A | | 5/1956 | Honey | |
| 2,889,623 A | | 6/1959 | Baker | 30/294 |
| 3,002,273 A | * | 10/1961 | Merritt | 30/2 |
| 3,641,667 A | * | 2/1972 | Leopoldi | 30/2 |
| 3,781,988 A | | 1/1974 | Jones | |
| 3,943,627 A | | 3/1976 | Stanley, Jr. | |
| 3,999,290 A | | 12/1976 | Wood | |
| 4,086,698 A | | 5/1978 | Sparks | |
| 4,091,537 A | | 5/1978 | Stevenson, Jr. | |
| 4,393,587 A | | 7/1983 | Kloosterman | |
| 4,523,379 A | | 6/1985 | Osterhout et al. | |
| 4,531,286 A | | 7/1985 | Vito et al. | |
| 4,569,133 A | | 2/1986 | Schmidt | |
| 4,675,996 A | * | 6/1987 | DuBuque | 30/2 |
| 4,683,656 A | * | 8/1987 | Peyrot et al. | 30/162 |
| 4,744,146 A | * | 5/1988 | Schmidt | 30/162 |

(List continued on next page.)

FOREIGN PATENT DOCUMENTS

| | | |
|---|---|---|
| DE | J 18560 Ic/69 | 8/1960 |
| DE | P 26 23 490.2-15 | 5/1976 |

(List continued on next page.)

*Primary Examiner*—Boyer D. Ashley
(74) *Attorney, Agent, or Firm*—Margaret Polson; Patent Law Offices of Rick Martin, P.C.

(57) ABSTRACT

The present invention has a safety hood which is pivotally mounted to the body of the knife at the front end. The body is pivotally mounted to a spine at the back end. The blade is removably mounted on the spine such that the hood covers the blade when the knife is closed. The hood is biased closed and has a latch to hold it closed unless the latch is released. The user depresses a button, which moves the latch, releasing the hood to push up when the user presses the hood against a working surface. The hood's rotation, and therefore the about of blade exposed, is controlled by an adjustable depth assembly. The adjustable depth assembly has multiple settings, allowing the user to control the cutting depth of the knife.

11 Claims, 13 Drawing Sheets

U.S. PATENT DOCUMENTS

| | | | | | |
|---|---|---|---|---|---|
| 4,757,612 | A | | 7/1988 | Peyrot | |
| 4,868,985 | A | | 9/1989 | Rehm | |
| 4,899,443 | A | * | 2/1990 | Beermann | 30/162 |
| 5,241,750 | A | | 9/1993 | Chomiak | |
| 5,325,594 | A | | 7/1994 | Szafranski | |
| 5,330,492 | A | | 7/1994 | Haugen | |
| 5,386,632 | A | | 2/1995 | Schmidt | |
| 5,404,645 | A | | 4/1995 | Janser | |
| 5,495,670 | A | | 3/1996 | Quinn | |
| 5,522,135 | A | | 6/1996 | Votolato | |
| 5,604,984 | A | | 2/1997 | Shepherd et al. | |
| 5,613,300 | A | | 3/1997 | Schmidt | |
| 5,617,635 | A | | 4/1997 | Berns | |
| 5,697,157 | A | * | 12/1997 | Votolato | 30/2 |
| 5,890,290 | A | | 4/1999 | Davis | |
| 5,909,930 | A | | 6/1999 | Ragland, III et al. | |
| 5,940,970 | A | | 8/1999 | D'Ambro, Sr. et al. | |
| 6,070,326 | A | * | 6/2000 | Berns | 30/2 |
| 6,148,520 | A | * | 11/2000 | Berns | 30/2 |
| 6,178,640 | B1 | * | 1/2001 | Votolato | 30/2 |
| 6,195,896 | B1 | * | 3/2001 | Ireland | 30/2 |
| 6,233,832 | B1 | | 5/2001 | Berns | |
| 6,484,404 | B1 | * | 11/2002 | Kao | 30/162 |
| 6,532,670 | B1 | * | 3/2003 | Berns | 30/339 |
| 6,557,262 | B1 | * | 5/2003 | Clemence et al. | 30/156 |
| 6,560,873 | B1 | * | 5/2003 | Ortner et al. | 30/2 |
| 6,578,266 | B2 | * | 6/2003 | Chomiak | 30/2 |

FOREIGN PATENT DOCUMENTS

| | | |
|---|---|---|
| DE | P 31 16 354.8-15 | 4/1981 |
| DE | G 81 19 855.8 | 7/1981 |
| DE | P 34 00 850.0 | 1/1984 |
| DE | P 34 33 286.3 | 9/1984 |
| DE | P 35 40 026.9 | 11/1985 |
| DE | G 89 12 929.6 | 11/1989 |
| EP | 87305970.3 | 7/1987 |
| WO | WO 00/64646 | 11/2000 |

* cited by examiner

AUTOMATIC SAFETY KNIFE

CROSS REFERENCE TO RELATED APPLICATIONS

This application is a divisional of application Ser. No. 09/863,511, filed on May 23, 2001 and issued as U.S. Pat. No. 6,560,873 on May 13, 2003, which is a continuation in part of application Ser. No. 09/439,133 filed on Nov. 12, 1999, now abandoned.

FIELD OF INVENTION

The present invention relates to a utility knife that reduces or eliminates the chances of accidental cuts. More particularly, this invention relates to a utility knife with a safety hood which automatically locks closed after the blade is used to make a single cut in a cardboard box or the like.

BACKGROUND OF THE INVENTION

Utility knives are well known and have a wide variety of uses. A well-recognized problem with these knives is that the user often accidentally cuts his/herself. This can occur when the user is handling and/or carrying the knife or accidentally cutting himself or herself when using the knife.

In many of the uses of utility knives, such as opening boxes or cutting linoleum, the user is often pulling the knife back towards his/her body, which is the most common way the user gets cut. When the knife reaches the edge of the work surface next to the user's body, the knife is accidentally pulled across the user's leg or other hand. The likelihood of such an injury is increased when the user is doing repetitive tasks. Many attempts have been made to make utility knives safer. Some of the patents attempting to address this issue are listed below.

U.S. Pat. No. 2,376,887 to Walters (1944) discloses a utility knife with a safety hood which is biased closed with a spring.

U.S. Pat. No. 2,889,623 to Baker (1957) discloses a wallpaper cutter where the cutting blade is forced down from between two rollers by thumb pressure.

U.S. Pat. No. 3,781,988 to Jones (1975) discloses a utility knife with a hood covering the blade. The hood is held down over the blade with a spring. Pressure on the bottom of the hood will expose the knife blade.

U.S. Pat. No. 3,999,290 to Wood (1976) discloses a utility knife with an automatically retracting blade.

U.S. Pat. No. 4,531,286 to Vito et al. (1985) discloses a utility knife with a hood covering the blade. The blade is uncovered by pressing a release lever built into the body. The release lever is depressed by normal gripping of the body. Pressing the bottom of the hood against a box could also expose the blade.

U.S. Pat. No. 4,868,985 to Rehn (1989) discloses a utility knife with an automatically retracting knife blade.

U.S. Pat. No. 5,241,750 to Chomiak (1993) discloses a utility knife with a hood covering the blade. The hood is held down over the blade with a spring. Pressure on the bottom of the hood will expose the knife blade. A lock lever allows the hood to be locked closed.

U.S. Pat. No. 5,386,632 to Schmidt (1995) discloses a utility knife with a retractable blade.

U.S. Pat. No. 5,404,645 to Janser (1995) discloses a utility knife with a moveable blade that can be placed in one of three different positions to provide three different cutting depths.

U.S. Pat. No. 5,494,670 to Quinn (1996) discloses a utility knife with a moveable blade pushed forward by the user.

U.S. Pat. No. 5,522,135 to Votolato (1996) discloses a utility knife with a hood covering the blade. The hood is held down over the blade with a spring. Pressure on the bottom of the hood will expose the knife blade.

U.S. Pat. No. 5,604,984 to Shepherd et al. (1997) discloses a utility knife with a rotary blade magazine. The blades can be moved in and out of the magazine as needed.

U.S. Pat. No. 5,613,300 to Schmidt (1995) discloses a utility knife with a retractable blade.

U.S. Pat. No. 5,617,635 to Berns (1997) discloses a utility knife with an automatically retracting blade.

U.S. Pat. No. 5,909,930 to Ragland, III et al. discloses a utility knife with a retractable blade.

U.S. Pat. No. 5,940,970 to D'Ambro, Sr. et al. discloses a utility knife with a retractable blade.

U.S. Pat. No. 6,070,326 to Berns discloses a utility knife with a retractable blade guard. The blade guard is a wire cage which extends around the blade and retracts back over it. A knife made by Martor-Argentax, assignee of the Berns patent had the same blade guard which is pushed back over the front edge of the blade, exposing the front point first, then sliding back perpendicular to the cutting surface. The blade guard is locked in position over the blade. The user must depress a release latch on the knife to allow the guard to move. Once the guard had moved, exposing the front edge of the blade, the release latch must be release and then re-depressed to release the cover again. The cover slides back into the body of the knife.

The two most common types of "safety knives" have either a retracting blade or a movable hood covering the blade. The retracting blades can be manual or automatic. The manual retractors do not solve the problem of accidental cuts while using the knife. Some of the auto-retracting blades have a button that must be depressed or pushed forward and held to keep the blade but. This reduces many accidental cuts, but often does not solve the problem of cuts that happen coming off the edge of the cutting surface. The user is not likely to release the button the second they reach the edge, particularly if they are cutting multiple things. In addition, keeping the button depressed can cause stress and cramping in the user's hand. Another danger of the auto-retracting blades is that the user can accidentally have his/her index finger at the front edge of the knife, against the blade, when it is retracted, cutting the finger.

The prior art utility knives with safety hoods are another attempt to reduce accidental cuts. The prior art hoods are generally biased closed with a spring or similar mechanism. Pressing on the bottom edge of the hood pushes the hood back, revealing the blade. Once the pressure on the bottom edge is released the hood closes again. The problem with these hoods is that as the user is drawing the knife across their leg or other body part accidentally they are putting pressure on the bottom edge of the hood, thereby exposing the blade.

The Martor knife with the wire blade guard is another type of safety knife. The Martor knife is designed to push the front edge of the blade through a surface to start the cutting. See FIG. 1*a*, '326 patent. Then the knife is pulled thought the working surface, against the cutting edge. This design does not work well for cutting open boxes as it requires puncturing into the box, risking cutting merchandise.

Another problem that is common with the use of utility knives is accidentally cutting what is under the cutting surface. For example, it is a common problem to have merchandise damaged by being accidentally cut when the shipping box is cut open. It is known in the art to restrict the depth of cut of the knife blade by reducing the amount the blade extends from the body of the knife. In the prior art knives the blade can be moved to extend different lengths beyond the body of the knife, allowing different depths of cut. However, all of the prior art knives move the blade of the knife to adjust the depth of cut. This is often a cumbersome process and it is not always easy to switch between cutting depths.

What is needed is a utility knife wherein the blade cannot be accidentally uncovered and will automatically close and lock a hood once the blade is removed from the cutting surface. Additionally the utility knife should allow the user to choose the depth of cut easily and to change easily between depths of cut.

The present invention solves these problems by having an automatically locking hood to cover the blade. The hood cannot move until a button is depressed to release the lock. The knife can then be used to cut a desired surface. The hood rotates back from the cutting edge when pressure is applied at the bottom edge of the hood by the cutting surface. The hood rotating back and then forward again resets the lock so that as soon as the pressure on the bottom edge is removed the hood closes and is re locked. The hood also controls the depth of cut of the blade. A movable, positive stop on the knife is used to control the amount that the hood can rotate back from the edge of the blade, preventing over cutting.

SUMMARY OF THE INVENTION

The primary aspect of the present invention is to provide a utility knife which significantly reduces the chances of the user or others being accidentally cut.

Another aspect of the present invention is to provide a utility knife that will automatically lock shut a cover for the blade once a cut is complete.

Another aspect of the present invention is to provide a utility knife that allows for controlling the depth of cut of the blade without the need to move the blade.

Another aspect of the present invention is to provide a utility knife where the depth of cut can easily be changed.

Another aspect of the present invention is to provide a utility knife that does not require the user to constantly keep a button depressed to use the blade.

Another aspect of the present invention is to provide a utility knife with a pivoting safety hood, wherein a traditional downward attach angle of about 45 degrees or less is used to minimized the blade penetration into a box, and, furthermore, the hood automatically is biased to the safety mode as the blade clears the box.

Other aspects of this invention will appear from the following description and appended claims, reference being made to the accompanying drawings forming a part of this specification wherein like reference characters designate corresponding parts in the several views.

The preferred embodiment of the present invention has a safety hood which is pivotally mounted to the body or cover of the knife at the front end. The body is pivotally mounted to a spine at the back end. The blade is removably mounted on the spine such that the hood covers the blade when the knife is closed. The hood is biased closed and has a latch to hold it closed unless the latch is released. The user depresses a button, which moves the latch, releasing the hood to push up when the user presses the hood against a working surface. The upward rotation of the hood releases the latch, so that when the hood rotates down the latch automatically re-locks the hood closed. The hood cannot be release again with out releasing the button and re-depressing the button.

A second embodiment has a safety hood that has two legs extending back to moveably connect the hood to the body of the knife. The legs act as springs to bias the hood down over the blade of the knife. The hood is locked in place over the blade with a safety catch holding one of the legs in place. The safety catch is released by depressing a button on the top of the knife, pushing the safety catch free of the leg, allowing it to move. The user can then use the knife to cut a desired surface.

As the hood rotates up away from the edge of the blade the safety catch is moved back into position to lock the hood. Once the pressure on the bottom surface of the hood is released the legs act as springs, moving the hood back into position covering the blade. As soon as the hood returns to the closed position the safety catch re-engages, locking the hood closed.

A slide on the body controls the amount the hood can rotate back from the blade, controlling the depth of cut of the blade. The slide can be set for a number of pre-determined cutting depths.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

DESCRIPTION OF THE DRAWINGS

Figure 1:
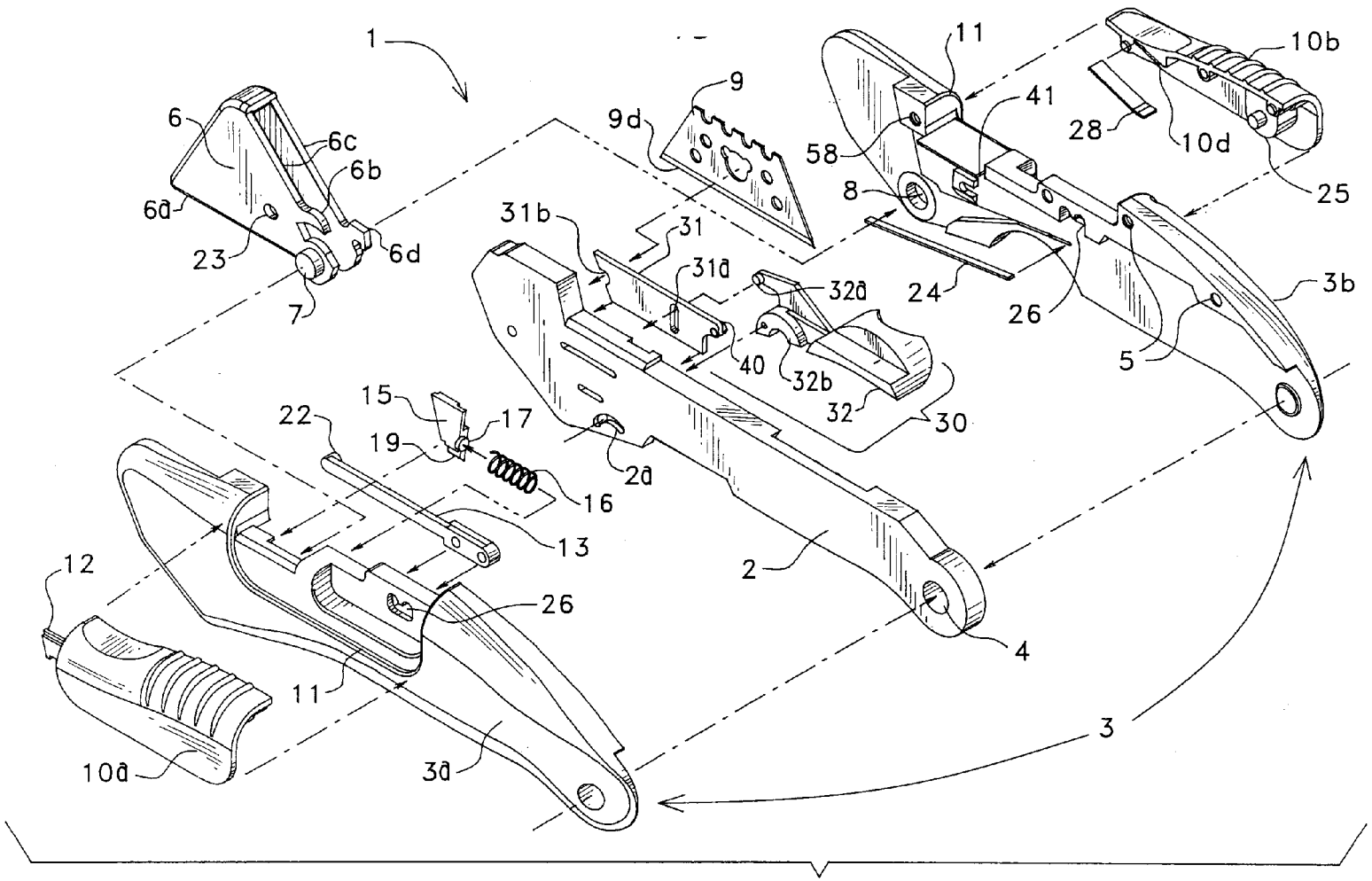
FIG. 1 is an exploded view of the preferred embodiment.

Referring first to FIG. 1, the preferred embodiment of the knife 1 has a cover (or body) 3 with two pieces 3*a*, 3*b*, and a spine 2. The cover 3 is pivotally mounted to the spine at pivot point 4. When assembled, the two pieces 3*a*, 3*b* of the cover 3 are attached together using screw or other similar attachments at holes 5 along the cover 3.

The hood 6 has bosses 7 which fit into holes 8 on the inside of cover pieces 3*a*, 3*b*. These bosses 7 function as a pivot, allowing the hood to rotate up to expose the blade 9. The hood 6 is biased closed by spring lever 24 pressing against nub 6*d*. In the preferred embodiment, the hood 6 is made from clear polycarbonate material to allow the user to easily examine the blade 9. All other parts but the blade 9 and any screws are made from a polycarbonate plastic or ABS plastic. Any sufficiently rigid plastic or similar material would work to form the parts. The blade 9 is removably mounted on the spine 2, as discussed below. In the preferred embodiment a Lewis #10 blade manufactured by Seal-O-Matic Corp. of Longmont Colo. is used.

Figure 8:
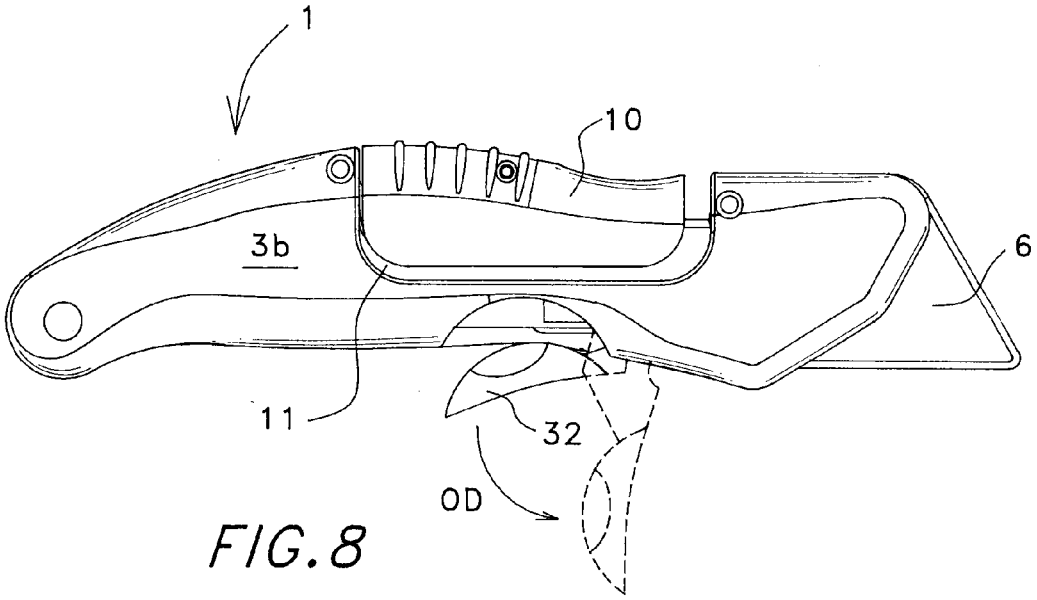
FIG. 8 is a side plan view of the latch being opened in direction OD.

The knife 1 has a button 10, formed in two pieces 10*a*, 10*b*. The button 10 is mounted on the cover 3 in cutaway 11, as shown in FIG. 8. The undersides of button pieces 10*a*, 10*b* have slots 10*c* as seen in FIGS. 2, 3, 4, and 10*d*, respectively. A spring lever 28 fits in slots 10*c* and 10*d*, biasing the button 10 to the up position. See FIG. 2.

Figure 2:
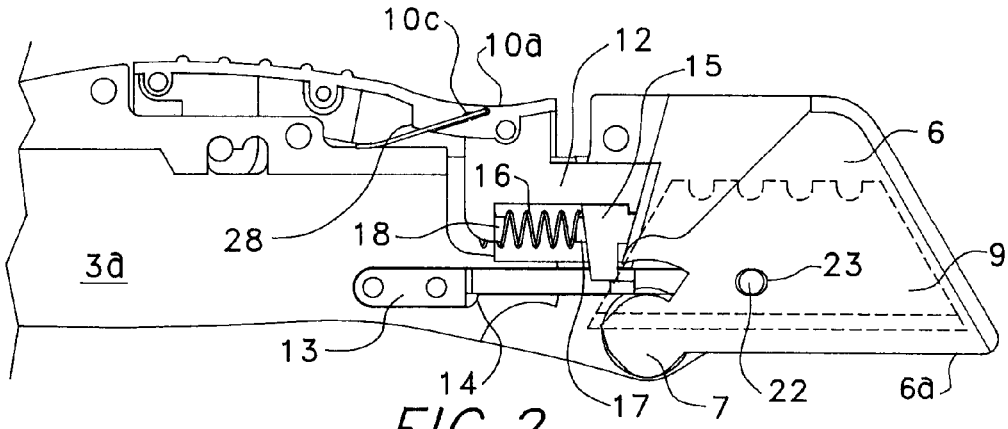
FIG. 2 is a partial cut away plan view of the preferred embodiment in the safe position before use.

As seen in FIGS. 1, 2 one piece 10*a* of the button 10 has an arm 12 which extends forward and down. A latch 13 is slidably mounted within space 14 in body piece 3*a* which is under the arm 12 when the knife 1 is assembled. Attached to the front bottom edge of the arm 12 is the release lever 15. A spring 16 is mounted between the back side 17 of the release lever 15 and a spring attachment point 18 on the back bottom side of the arm 12. The release lever's bottom edge 19 is slanted upward. See FIG. 7.

Figure 7:
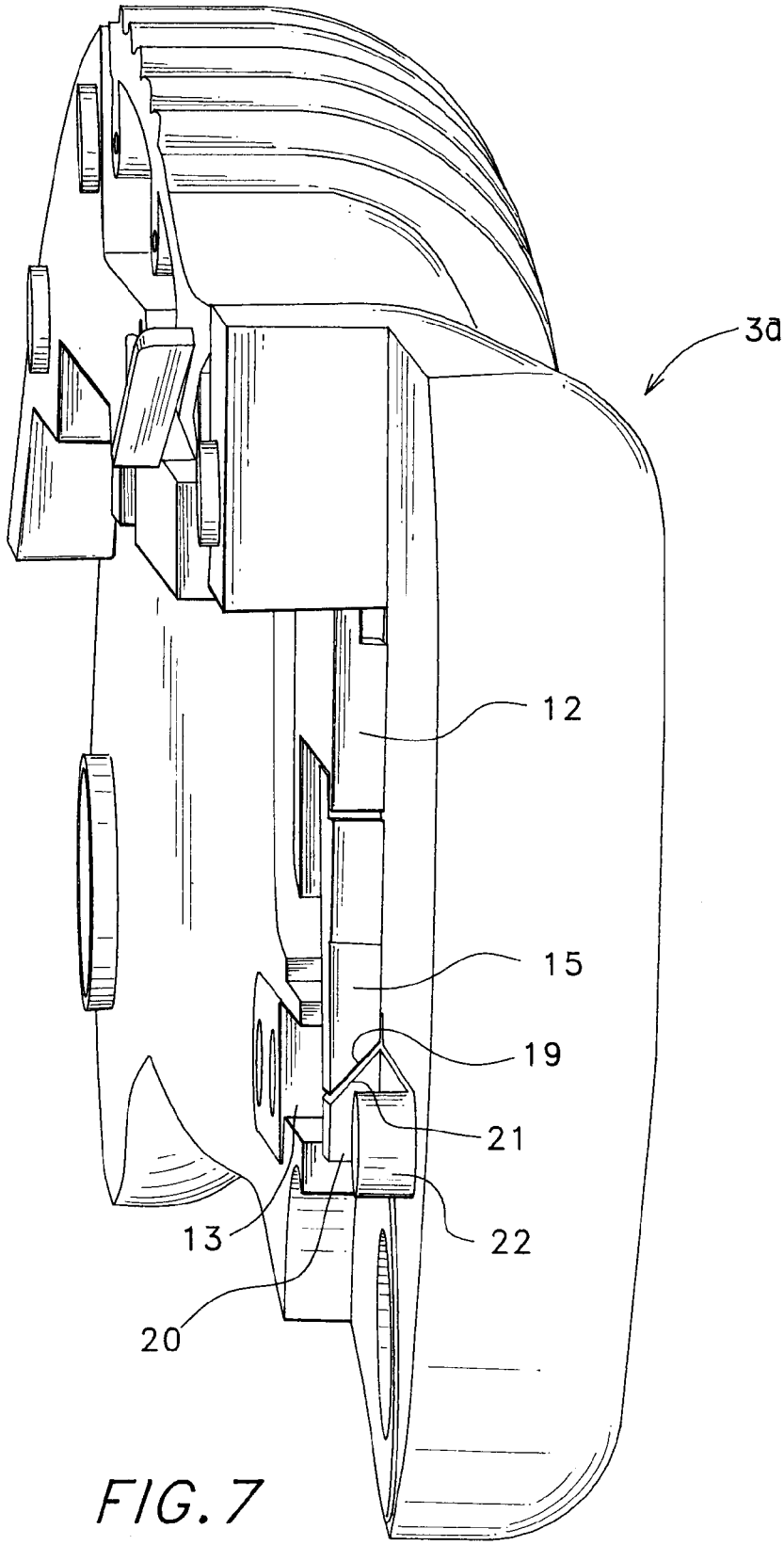
FIG. 7 is a partially disassembled front perspective view of the latch and the release.

The latch 13 has a catch 20 with a slanted upper surface 21 which engages the bottom edge 19 of the release lever 15 as shown in FIG. 7. At the forward end of the latch 13 is a hood lock 22 as also shown in FIG. 1. All of these components form the hood locking mechanism.

Figure 3:
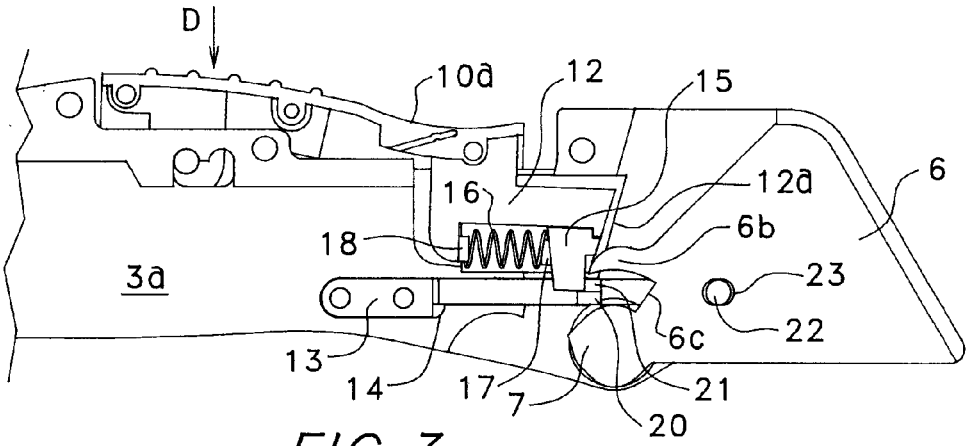
FIG. 3 is a partial cut away plan view of the preferred embodiment with the button depressed and the hood unlocked.
Figure 4:
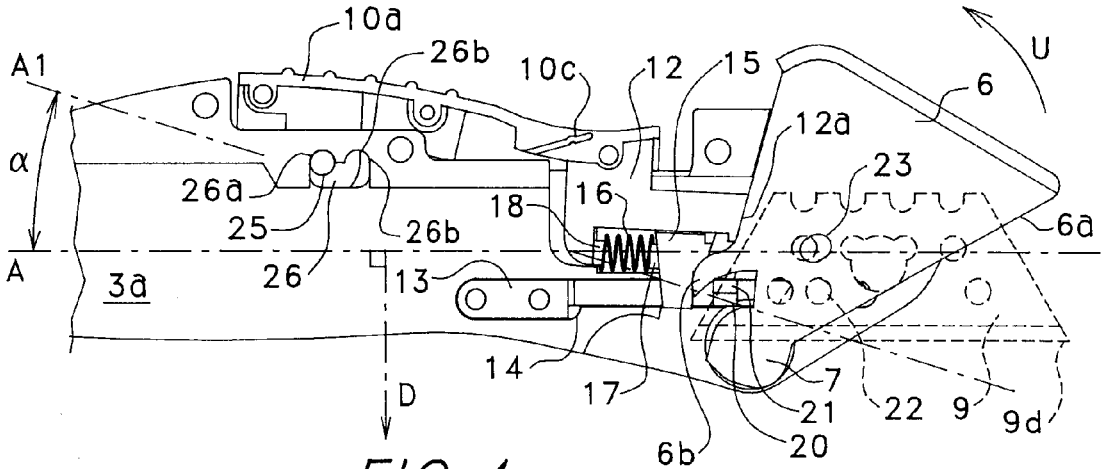
FIG. 4 is a partial cut away plan view of the hood moving up to expose the blade.

FIG. 1 shows the hood 6 has a hole 23 shaped to receive the hood lock 22. When the hood 6 is in the safe position with the hood 6 covering the blade 9, the hood lock 22 is positioned in hole 23, preventing the hood 6 from moving, as shown in FIG. 2. When the user is going to use the knife s/he presses down on the button 10 in direction D with a thumb, depressing the button 10 down as shown in FIG. 3. This presses the release lever 15 down against the slanted surface 21 of the catch 20. As the release lever 15 presses down, it pushes the latch 13 back into space 14 disengaging the hood lock 22 from hole 23 in the hood 6, unlocking the hood 6. See also FIG. 7. The knife 1 has a longitudinal axis A as shown in FIG. 4. Once the hood 6 is unlocked the user would tip back of the knife 1 upward at an angle $\propto$ to allow the open edge 6*a* of the hood 6 to be pressed down in direction D against a working surface. Longitudinal axis A is horizontal. Angle $\propto$ is nominally about 45° or less to cut as shown by A1 in dashed lines.

The unlocked hood 6 rotates upwards in direction U around bosses 7 when the user presses the open edge 6*a* against a working surface and exposes the cutting edge 9*a* of blade 9 as shown in FIG. 4.

Referring back to FIG. 3, as the hood 6 moves upward a projection 6*b* on the back edge 6*c* presses back against the release lever 15, moving the release lever 15 backward and compressing spring 16. As release lever 15 moves back, it is moved off of catch 20, releasing latch 13 to move. See FIG. 7. As the hood lock 22 is no longer aligned with hole 23 of hood 6, as shown in FIG. 4, the latch 13 cannot move all the way back to the locked and safe position.

Figure 5:
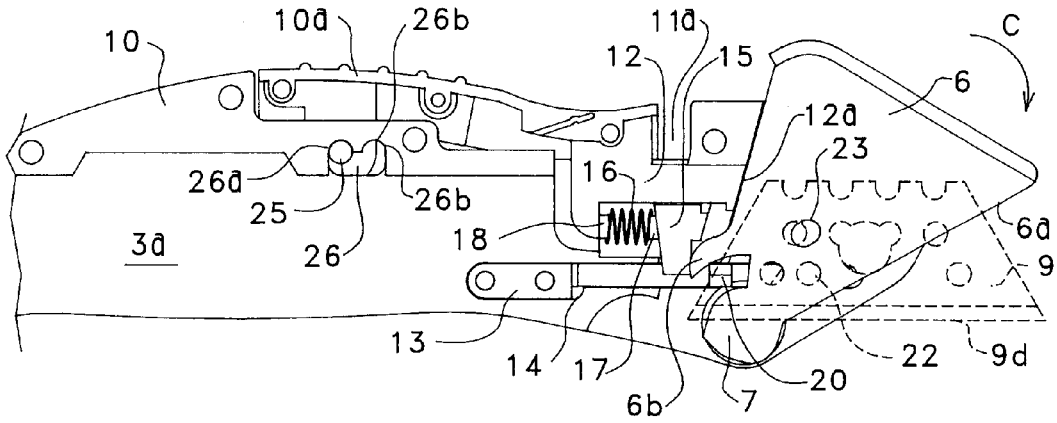
FIG. 5 is a partial cut away plan view of the hood in the up position and the button in the released position.
Figure 6:
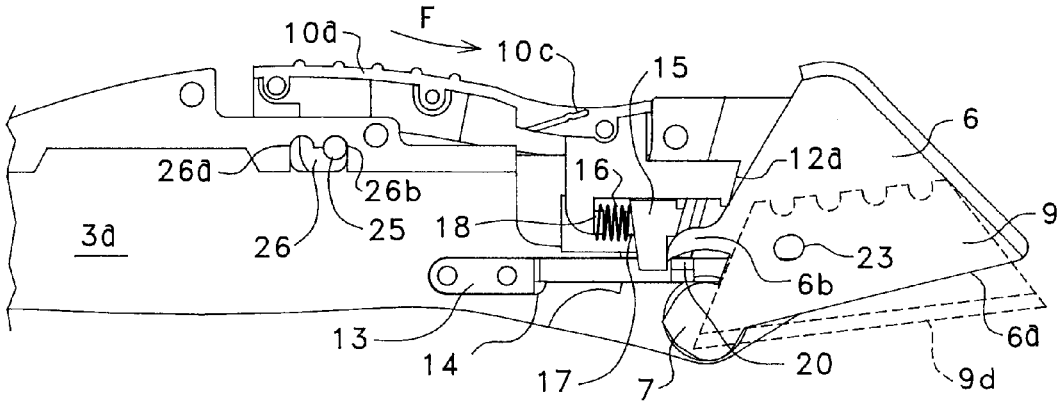
FIG. 6 is a partial cut away plan view of the button slid forward and the hood in the up position.

FIG. 5 shows the hood 6 in the up position with the button 10 released. The projection 6*b* is still pressed against release lever 15, preventing the release lever 15 from engaging the latch 13. So long as the hood 6 remains up, the position of the button 10, formed of button pieces 10*a*, 10*b*, has no effect on the latch 13 as the release lever 15 is now behind the catch 20. The latch 13 will remain pressed against the hood 6 and the user cannot re-engage the release lever 15 with the catch 20. As soon as the user finishes cutting a working surface the open edge 6*a* of the hood 6 will no longer be pressed upward. Spring lever 24 will then snap the hood 6 back to the safe position in direction C covering the blade 9. See FIG. 1. As the hood 6 moves down, the latch 13 will press the hood lock 22 back into hole 23 as soon as the hood 6 is closed. If the button 10 is still depressed as shown in FIG. 6, the release lever 15 will remain behind the catch 20, unable to move the latch 13. If the user wants to use the knife 1 s/he must release the button 10 and depress the button 10 again. Until the button 10 is released, the hood 6 cannot be unlocked.

In operation, the user would press the button 10 down and then press the open edge 6*a* of the hood 6 against any working surface s/he wished to cut, a cardboard box for example. As the hood 6 is pressed against the box with the button 10 pressed down, the cutting edge 9*d* of the blade 9 is exposed, allowing the user to cut the box. The user can pull the knife 1 along the box to make the desired cut. When the user either lifts the knife 1 away from the box or reaches the edge of the box, the hood 6 will no longer be pushed up by the working surface. The spring lever 24 biases the hood 6 closed causing the hood 6 to automatically swing to the closed position. Once the hood 6 is in the closed position, the latch 13 will press the hood lock 22 back in to hole 23 in the hood 6, re-latching the hood 6 in the closed and safe position. If the user wishes to make another cut, s/he must release the button 10 and depress the button 10 again when the hood 6 is in the closed position. The hood 6 cannot be unlocked without releasing the button and then depressing the button 10 again once the hood 6 is closed.

As shown in FIGS. 3, 4, 5, 6 the front edge 12*a* of the arm 12 acts as a positive stop, or adjustable depth assembly, to control the distance the hood 6 can rotate upward in direction U. This controls the depth of cut that can be made with the knife 1. If the user slides the button 10 forward in space 11*a*, as shown in FIG. 5, the front edge 12*a* is moved forward as shown in FIG. 6, limiting rotation of the hood 6 and thereby decreasing the amount of the blade 9 that is exposed. Button 10 has a nub 25 on the underside which fits into hole 26 as shown in FIG. 1. Hole 26 has notches 26*a*, 26*b* to fit nub 25, holding the button 10 in place as shown in FIGS. 4, 5 and 6. The user can move the button 10 forward in direction F or back to control the amount of blade 9 exposed and, therefore, the depth of cut possible with the knife 1. The notches 26*a*, 26*b* act as positive stops to hold the nub 25 and thus, the button 10 in place, preventing the pressure placed on the hood 6 while in use from pushing the button 10 back. Two notches are shown, but more could be provided if desired. In the preferred embodiment the two notches 26*a*, 26*b* are set to allow for cutting depths of ¼ of an inch and ¾ of an inch, respectively.

Referring back to FIG. 1, the spine 2 is pressed against the hood locking mechanism when the knife 1 is assembled. The blade 9 is mounted on the opposite side of the spine 2 from the hood locking mechanism. The blade 9 is held in place on the spine 2 with a blade locking mechanism 30 shown in FIGS. 1, 9, 10, and 11. The blade locking mechanism consists of two parts, the blade holder 31 and the handle 32. Handle 32 is shown in relation to knife 1 in FIG. 8.

The blade 9 is placed in a space on spine 2, blade mount 33. Blade mount 33 is underneath blade 9 in FIG. 1. In the preferred embodiment there are three posts 34, depicted as 34*a*, 34*b*, 34*c*, on the blade mount 33. The posts 34*a*, 34*b*, 34*c*, correspond with holes found in the blade 9, or holes 9*a*, 9*b*, 9*c*, respectively. Post 34*a* extends through hole 9*a* and beyond the surface of the blade 9 when the blade 9 is placed on blade mount 33.

Figure 9:
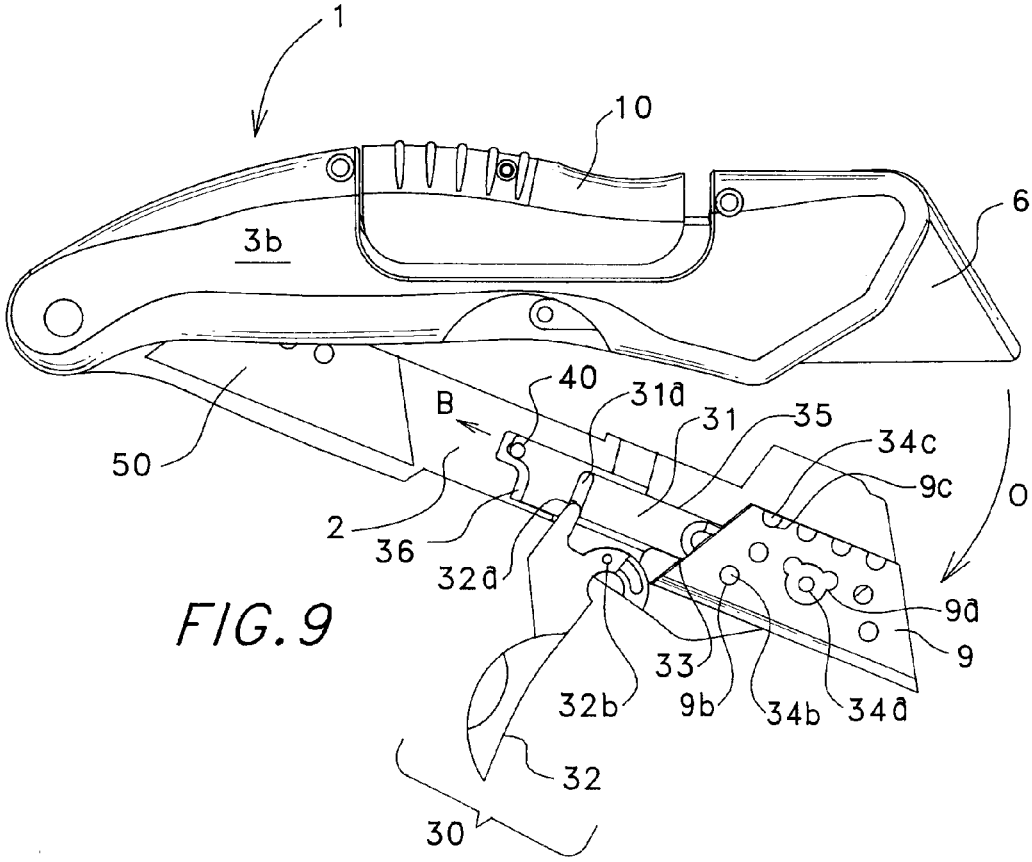
FIG. 9 is a side plan view of the knife being opened in direction O.
Figure 10:
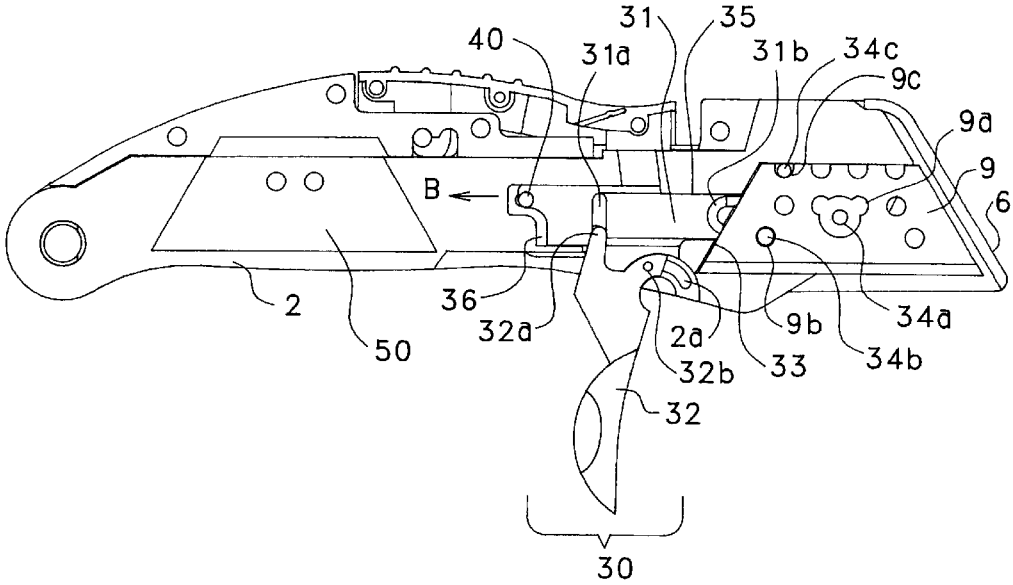
FIG. 10 is a partial cut away plan view of the knife open with the blade holder slid open to allow the removal of the blade.
Figure 11:
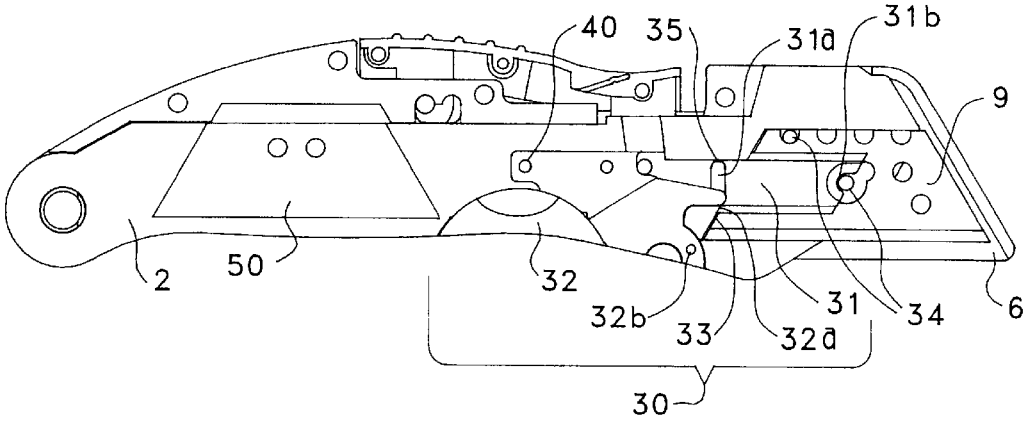
FIG. 11 is a partial cut away plan view of the knife with the blade holder closed to hold the blade in place.

Behind the blade mount 33 on spine 2 is a groove 35 shaped to receive the blade holder 31 and the handle 32. The blade holder 31 is slideably mounted in groove 35, allowing the holder 31 to move forward and back. Holder attachment post 32*a* on handle 32 is set in groove 31*a* in the blade holder 31. This post and groove attachment mechanism slideably attaches the blade holder 31 and the handle 32 as seen in FIGS. 1, 9, 10 and 11. The handle 32 is also slidably attached to groove 2*a* in the spine 2 at spine attachment point 32*b*. The effect of the two slidable attachments is shown in FIGS. 8, 9, 10. As the handle 32 is moved out and down in direction OD, the blade holder 31 slides backwards in groove 36 in direction B. Then as the handle 32 is pushed toward and against the spine, the blade holder 31 also moves forward in a direction opposite of B, sliding over the blade 9 as shown in FIG. 11, and trapping the blade 9 against the blade mount 33. The front edge of the blade holder 31 has notch 31*b* which abuts post 34*a* when the handle 32 is all the way closed.

The blade locking mechanism 30 moves the body latch 40, which is located on the back end of blade holder 31, into notch 41 on the inside of body piece 3*b*, functioning to lock the knife 1 closed for use. The notch 41 is shown in FIG. 1. The body latch 40 can be seen on FIGS. 9, 10 and 11. As the handle 32 is moved away from the body, as shown in FIG. 8,the blade holder moves backward in groove 36 and the body latch 40 pulls back out of notch 41. The cover 3 can then be pivoted up away from the spine 2.

A spare blade holder space 50 can be provided on the spine 2 at the opposite end from the blade mount 33 to allow for the storage of extra blades 9 within the knife 1 itself, as shown in FIGS. 9, 10, 11.

Figure 12:
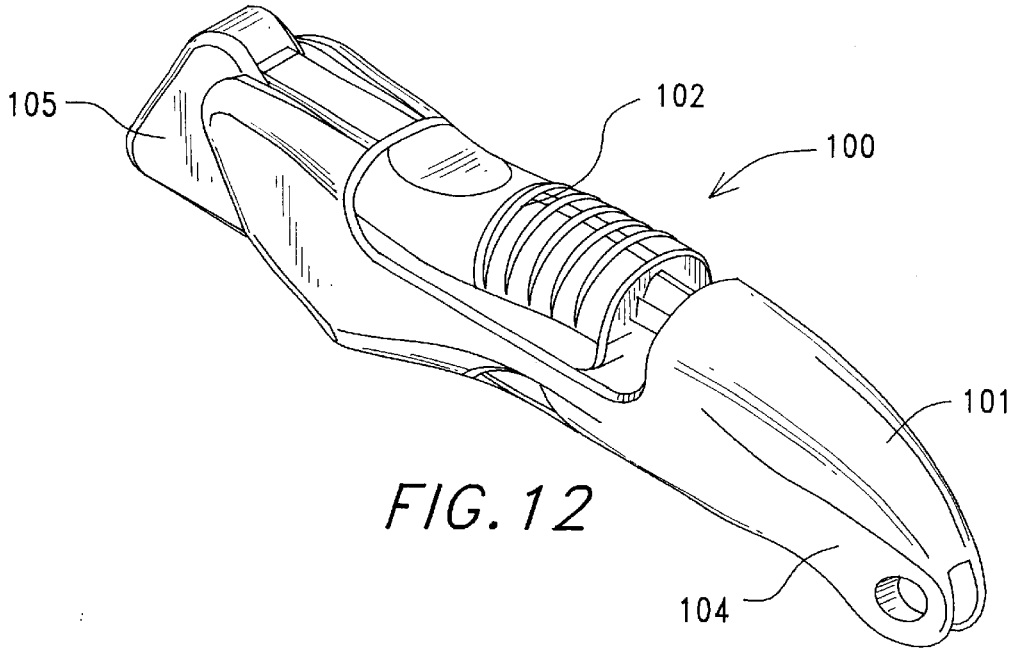
FIG. 12 is a top perspective view of the alternate embodiment.
Figure 13:
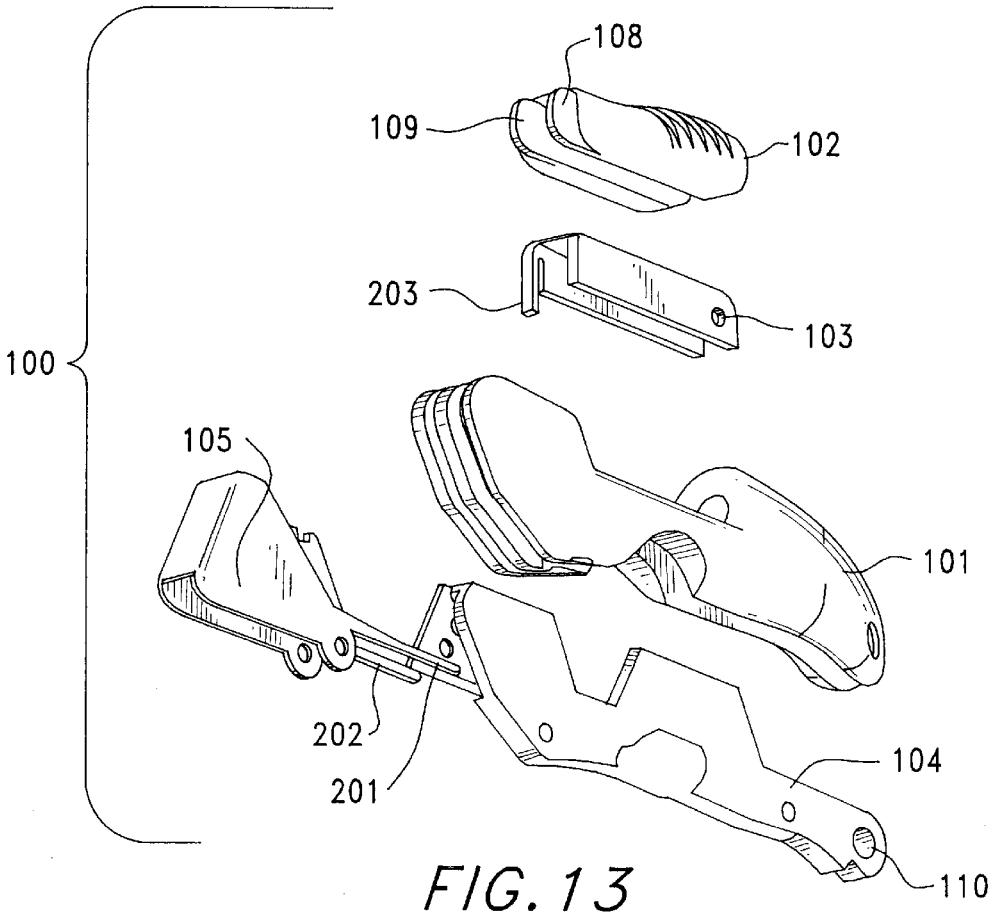
FIG. 13 is an bottom perspective exploded view of the alternate embodiment without the blade.
Figure 14:
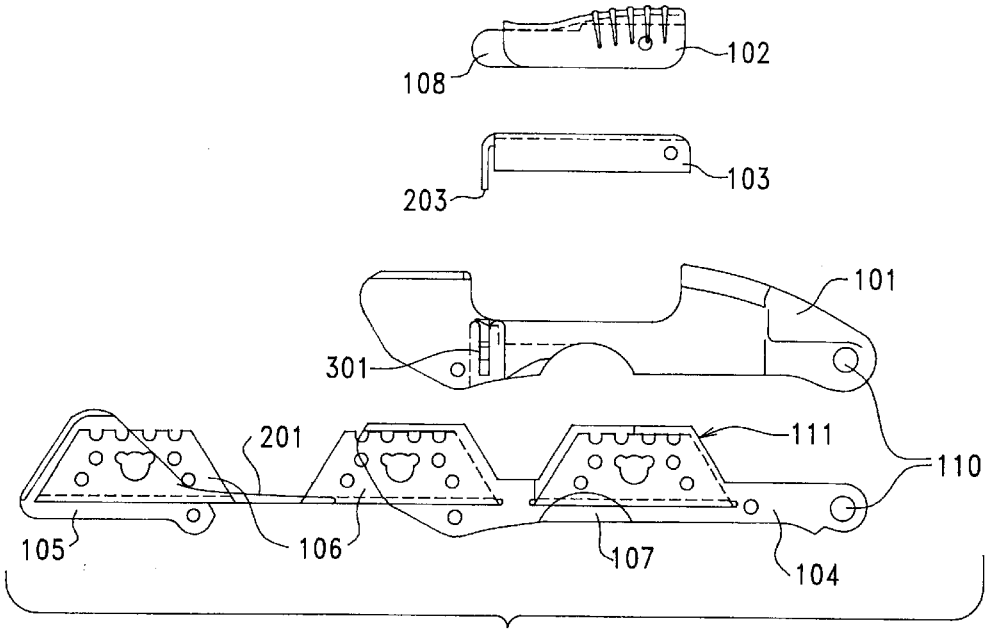
FIG. 14 is an exploded plan view of the alternate embodiment showing the relation of the blade to the hood and the body and the storage of extra blades.

An alternate embodiment of the knife is shown in FIGS. 12–26. As seen in FIGS. 12, 13, and 14 the knife 100 has a body 101, a spine 104, a hood 105, a button 103 under spine 104 and a slide 102. The slide has ears 108, 109 extending forward. The hood 105 has legs 201, 202 which function as springs to bias the hood 105 to the closed position shown in FIG. 15. The cutting blade 106 is shown in FIG. 14 in relation to both the spine 104 and the hood 105.

Figure 15:
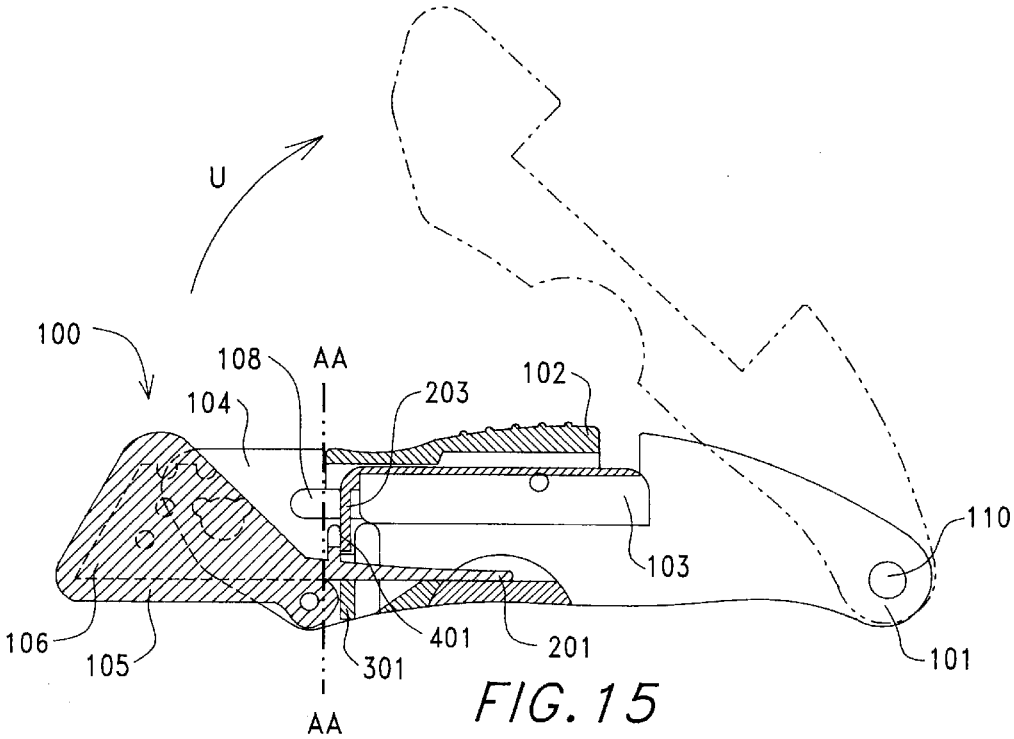
FIG. 15 is a side plan view of the alternate embodiment with the hood closed with the body partially cut away.

The body 101 is pivotally attached to the spine 104 at pivot point 110. One or more spare blades 107 can be stored in compartment 111 in the spine 104 which can be accessed by pivoting open the body 101 as shown in FIG. 15. The blades 106, 107 are standard steel utility knife blades well known in the art. In the preferred embodiment a Lewis #10 blade manufactured by Seal-O-Matic Corp. of Longmont Colo. is used. The cutting blade 106 is attached to the spine 104 with a screw or post in the manner well known in the art. The cutting blade 106 is fixed in position and does not move during the operation of the knife 100.

The body 101, hood 105, and button 103 are made from a polycarbonate material. There are a number of polycarbonate materials known in the art that would all function equally well. In the preferred embodiment the hood 105 is made from a transparent or translucent polycarbonate to allow easy visual examination of the blade 106. The slide 102 may be made from an acetal copolymer or an acetal copolymer selected from the polymers known in the art. The spine 104 is preferentially made from die cast zinc or aluminum. The material that the hood 105, body 101, and button 103 are made from must be flexible enough to allow the components to function as described below.

Figure 16:
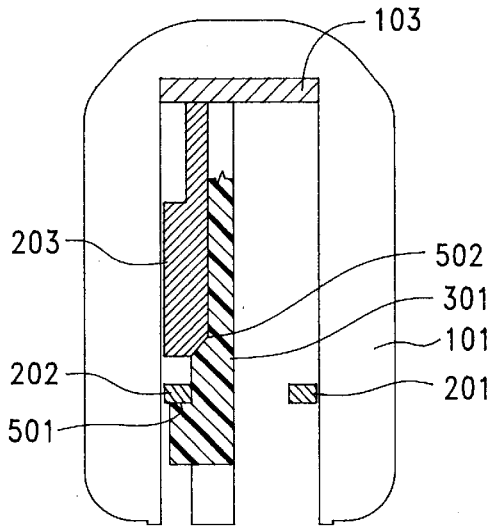
FIG. 16 is a cross sectional view of the knife along line AA—AA of FIG. 15 with the safety catch engaged.

FIG. 15 shows the relation of the body 101, the slide 102, the button 103 and the hood 105 in operation. The body 101 is partially cut away to show the detail. The hood 105 has legs 201 and 202 as shown in FIG. 13 which are movably attached to the body 101. In the closed position illustrated in FIG. 15, the legs 201, 202 extend backward from the hood 105. Leg 202 has a tab 401. The body 101 has safety catch 301 on the inside. The button 103 has a release post 203 extending down on one side as seen in FIG. 13. The release post 203 is positioned adjacent to the safety catch 301 and above leg 202 as shown in FIG. 16 which is a cross sectional view along line A—A of FIG. 15. The safety catch 301 has a first notch 501 to engage the leg 202 and a second notch 502 to engage the release post 203. The first notch 501 against the leg 202 locks the hood 105 in the closed position.

Figure 17:
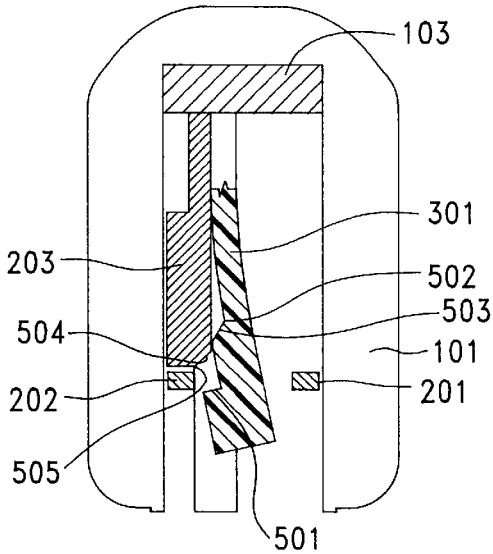
FIG. 17 is a cross sectional view of the knife along line AA—AA of FIG. 15 with the release post moving the safety catch out of the lock position.

In operation the user presses the slide 102 which in turn depresses the button 103 underneath the slide 102 to release the hood 105. As shown in FIG. 17, pressing the slide 102 and button 103 down pushes the release post 203 down and out of engagement with the second notch 502 of the safety catch 301. This pushes the safety catch 301 to one side and away from leg 202, allowing the hood 105 to move. At the second notch 502, a sloped bottom surface 503 matches a sloped surface 504 on the release post 203 at point 505.

Figure 18:
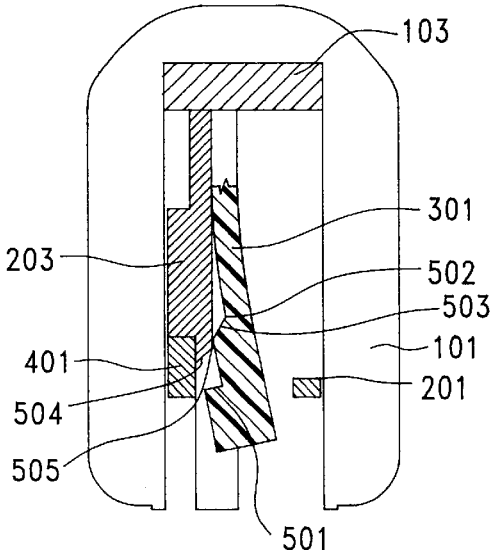
FIG. 18 is a cross sectional view of the knife along line AA—AA of FIG. 15 with the hood rotating up, pushing the release post off the safety catch.
Figure 19:
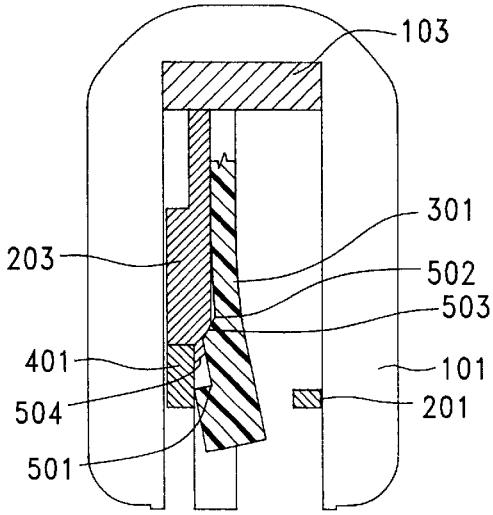
FIG. 19 is a cross sectional view of the knife along line AA—AA of FIG. 15 with the hood fully rotated and the safety catch ready to re-engage.

These slopes 503, 504 allow for smooth button operation when the button 103 is depressed and reduces the initial force required to depress the slide 102 and button 103. As seen in FIGS. 18, 19, with the safety catch 301 moved off to one side, the hood 105 can now rotate up, exposing tab 401.

Figure 22:
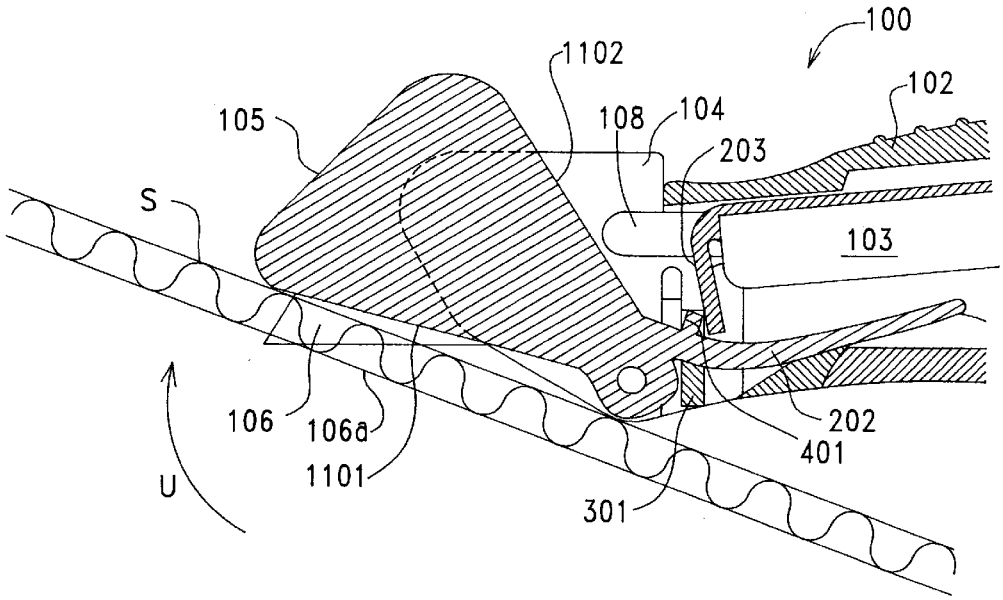
FIG. 22 is a side plan view of the knife cutting a surface with the hood set for a ¼ inch cut.

As the hood rotates up in direction U, the legs 201, 202 slide back and bend some (see FIG. 22). As the hood 105 is pressed up, the tab 401 on leg 202 presses back against the release post 203. After the safety catch is disengaged, the hood 105 begins significant movement. The tab 401 presses the release post 203 back, out of the way of safety catch 301. The safety catch 301 moves back up against the leg 202, but cannot lock the leg 202 because of the presence of tab 401 as seen in FIG. 19.

Figure 20:
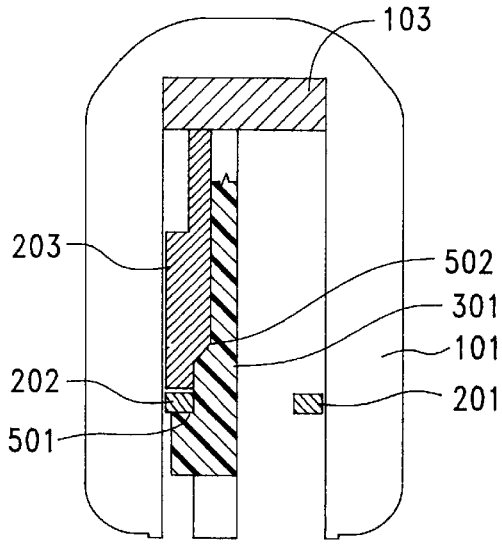
FIG. 20 is a cross sectional view of the knife along line AA—AA of FIG. 15 with the hood closed and re-locked.

At the end of a cut, the spring action of the bent leg 202 forces the hood 105 back to the closed position. As shown in FIG. 20 the first notch 501 re-engages the leg 202, locking the leg 202 in position. The release post 203 is still behind the safety catch 301. In order to allow the release post 203 to re-engage the safety catch 301 the user must release slide 102 and button 103. The bend in the release post 203 biases the button 103 up. The hood 105 cannot be moved without letting the button 103 move up and then re-depressing the button 103.

The position of slide 102 controls how far back the hood 105 can rotate as well as controlling the amount of the cutting blade 106 that is exposed, functioning as a adjustable depth assembly. In the preferred embodiment the slide 102 has three positions exposing ¼, ½, and ¾, inches of blade respectively.

Figure 21:
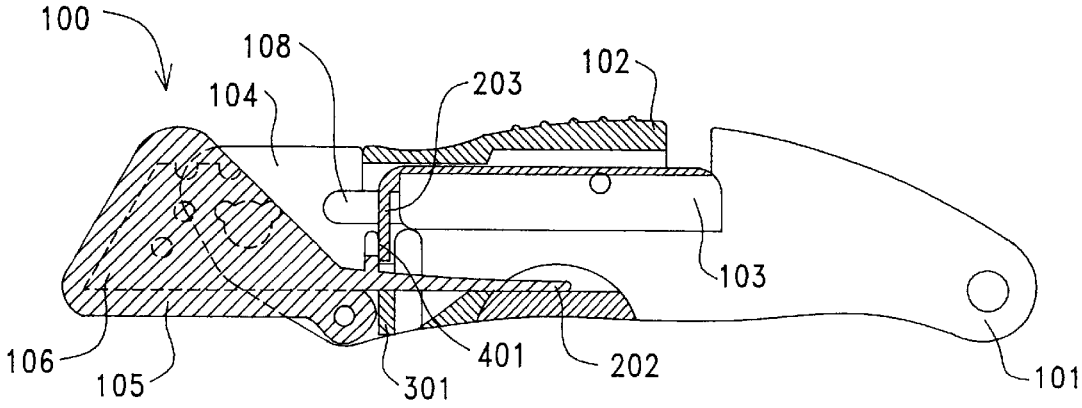
FIG. 21 is a side plan view of the knife with the slide positioned to allow the hood to rotate back for a ¼ inch cutting depth.

The first position exposing ¼ inch of blade is shown in FIG. 21. The slide 102 is moved all the way forward and against the spine 104 with ears 108, 109 extending toward the hood 105. As the knife 100 is used to cut a box or other cutting surface S the hood 105 is pressed against the cutting surface S at the bottom edge 1101 of the hood 105 as shown in FIG. 22. This causes the hood 105 to rotate back, exposing the cutting edge 106*a* of the blade 106. The rotation of the hood 105 is stopped when the back edge 1102 of the hood 105 contacts the ears 108, 109 on the spine 104. With the slide 102 in the first position the hood can rotate back to expose ¼ inch of blade 106 in the preferred embodiment.

Figure 23:
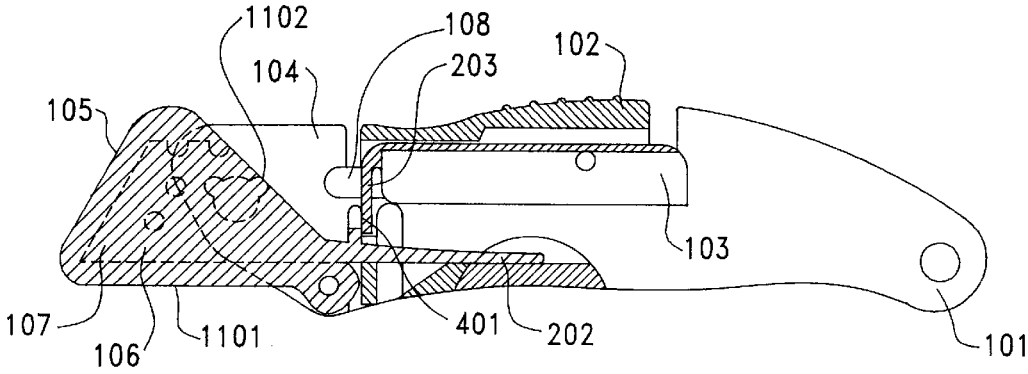
FIG. 23 is a side plan view of the knife with the slide positioned to allow the hood to rotate back for a ½ inch cutting depth.
Figure 24:
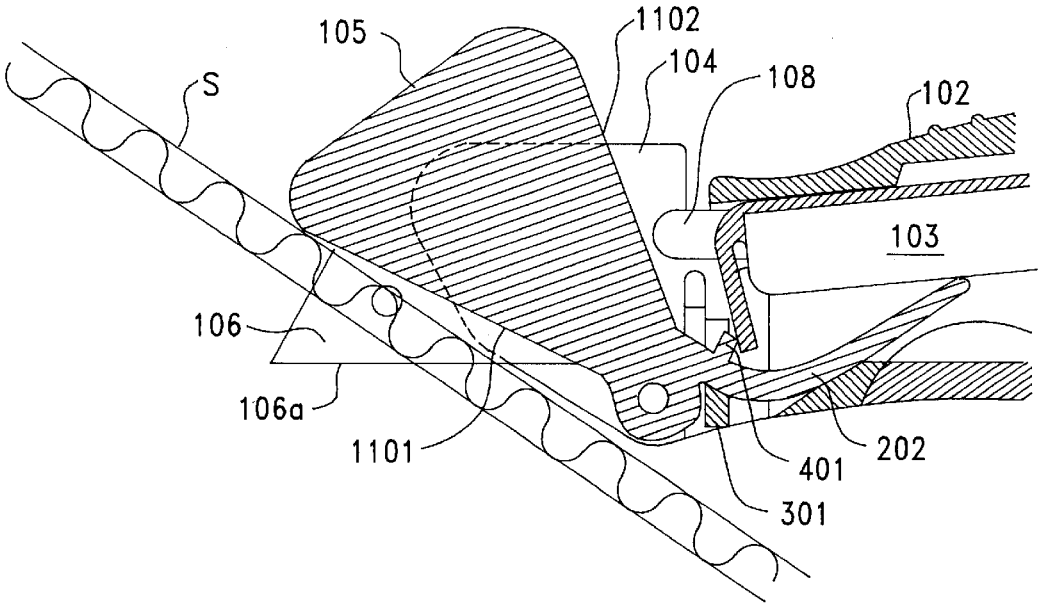
FIG. 24 is a side plan view of the knife cutting a surface with the hood set for a ½ inch cut.

The second position exposing ½ inch of blade is shown in FIG. 23. The slide 102 is set back slightly from the spine 104 with ears 108, 109 extending toward the hood 105. As the knife 100 is used to cut a box or other cutting surface S the hood 105 is pressed against the cutting surface S at the bottom edge 1101 of the hood 105 as shown in FIG. 23. This causes the hood 105 to rotate back, exposing the cutting edge 106*a* of the blade 106. The rotation of the hood 105 is stopped when the back edge 1102 of the hood 105 contacts the ears 108, 109 of spine 104. With the slide 102 in the second position the hood can rotate back to expose ½ inch of blade 106 in the preferred embodiment.

Figure 25:
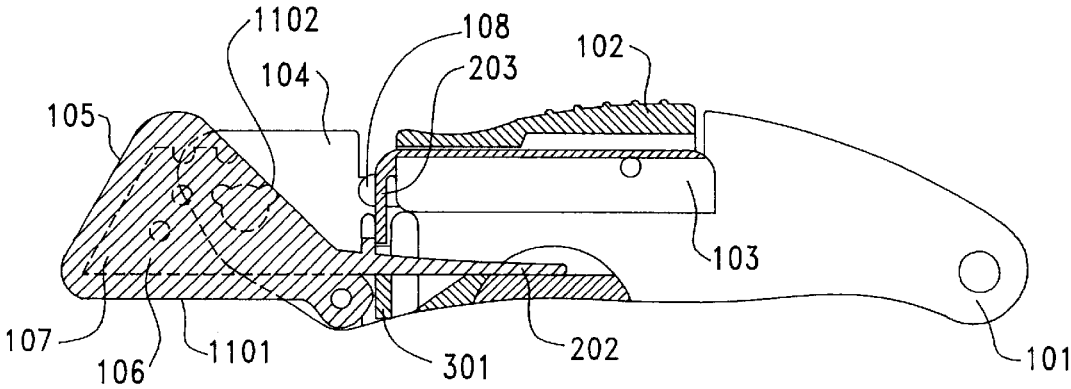
FIG. 25 is a side plan view of the knife with the slide positioned to allow the hood to rotate back for a ¾ inch cutting depth.
Figure 26:
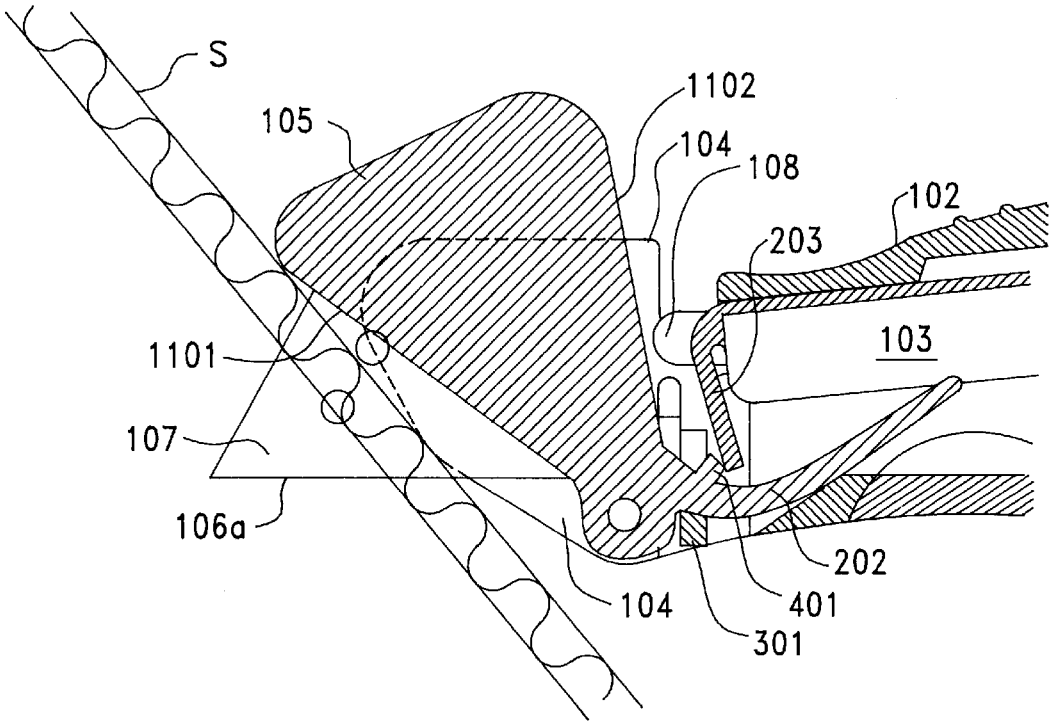
FIG. 26 is a side plan view of the knife cutting a surface with the hood set for a ¾ inch cut.

The third position exposing ¾ inch of blade is shown in FIG. 25. The slide 102 is moved all the way back with ears 108, 109 of spine 104 extending toward the hood 105. As the knife 100 is used to cut a box or other cutting surface S the hood 105 is pressed against the cutting surface S at the bottom edge 1101 of the hood 105 as shown in FIG. 26. This causes the hood 105 to rotate back, exposing the cutting edge 106*a* of the blade 106. The rotation of the hood 105 is stopped when the back edge 1102 of the hood 105 contacts the ears 108, 109 of spine 104. With the slide 102 in the third position the hood can rotate back to expose ¾ inch of blade 106 in the preferred embodiment.

Although the present invention has been described with reference to preferred embodiments, numerous modifications and variations can be made and still the result will come within the scope of the invention. No limitation with respect to the specific embodiments disclosed herein is intended or should be inferred.

What is claimed is:

1. A utility knife having an adjustable depth assembly, said utility knife comprising:

a spine;

a body movably attached to the spine;

a blade mounted on the spine;

a pivotal safety hood mounted to the body having a safe position covering the blade and an operating position exposing the blade;

said adjustable depth assembly comprising a movable positive stop mounted behind the pivotal safety hood; and said movable positive stop having a plurality of locked positions, wherein each locked position stops a rearward rotation of the pivotal safety hood at a different cutting depth, thereby providing an adjustable cutting depth for the blade.

2. The utility knife of claim 1 further comprising the blade being removably mounted on the spine, and the moveable positive stop further comprising a connection to a sliding button assembly mounted on the body.

3. The utility knife of claim 2, wherein the positive stop has at least two set positions.

4. The utility knife of claim 2 wherein the body movably attached to the spine is pivotally attached.

5. The utility knife of claim 2 further comprising:

a latch on the body releasing the hood to move from the safe position to the operating position; and an automatic lock means associated with the latch, to lock the hood upon a return to the safe position when the hood is biased beyond the working surface after a cutting operation.

6. The utility knife of claim 2, wherein the positive stop has two positions.

7. The utility knife of claim 6, wherein the two positions allow an approximately 0.635 cm (¼ inch) and 1.905 cm (¾ inch) cutting depth respectively.

8. The utility knife of claim 2, wherein the positive stop has 3 positions.

9. The utility knife of claim 8, wherein the three positions allow an approximately a 0.635 cm (¼ inch), 1.27 cm (½ inch) and 1.905 cm (¾ inch) cutting depth respectively.

10. A quick release blade assembly for a utility knife having a replaceable blade, said utility knife comprising:

a cover pivotally mounted to a spine;

said spine having a blade mount;

a quick release means pivotally and slidably affixed to the spine; and said quick release means having a blade holder for the blade and a body latch means to lock the cover to the spine in a closed position.

11. A utility knife having an adjustable depth assembly means, said utility knife comprising:

a spine;

a body movably attached to the spine;

a blade mounted on the spine;

a pivotal safety hood means mounted to the body having a safe position covering the blade and an operating position exposing the blade;

said adjustable depth assembly means comprising a movable positive stop means mounted behind the pivotal safety hood means; and said movable positive stop having a plurality of locked positions, wherein each locked position functions to stop a rearward rotation of the pivotal safety hood at a chosen cutting depth, thereby providing an adjustable cutting depth for the blade.

* * * * *